US005615806A

United States Patent [19]

Grothoff

[11] Patent Number: 5,615,806

[45] Date of Patent: Apr. 1, 1997

[54] PLUNGER LOCK-UP DISPENSER

[75] Inventor: Hans Grothoff, Dortmund, Germany

[73] Assignee: Calmar-Albert GmbH, Hemer, Germany

[21] Appl. No.: 655,923

[22] Filed: May 31, 1996

[51] Int. Cl.[6] ..... B67D 5/33

[52] U.S. Cl. ..... 222/153.13; 222/384

[58] Field of Search ..... 222/153.13, 384, 222/321.9, 383.1, 382, 385

[56] References Cited

U.S. PATENT DOCUMENTS

| | | | |
|---|---|---|---|
| 3,187,960 | 6/1965 | Gorman . | |
| 3,489,322 | 2/1970 | Ayres . | |
| 3,500,761 | 3/1970 | Clevenger et al. . | |
| 3,590,691 | 7/1971 | Magers . | |
| 3,601,290 | 8/1971 | Nigro . | |
| 3,608,788 | 9/1971 | Tanaka . | |
| 3,724,726 | 4/1973 | Susuki et al. . | |
| 4,155,489 | 5/1979 | Steiman . | |
| 4,162,746 | 7/1979 | Anderson et al. . | |
| 4,420,096 | 12/1983 | Kirk, Jr. . | |
| 4,434,916 | 3/1984 | Ruscitti et al. . | |
| 4,589,574 | 5/1986 | Foster | 222/153.13 |
| 4,732,549 | 3/1988 | Von Schuckman | 222/384 |
| 4,991,746 | 2/1991 | Schultz . | |
| 5,335,830 | 8/1994 | Cater | 222/153.13 |

FOREIGN PATENT DOCUMENTS

| | | | |
|---|---|---|---|
| 2124711 | 2/1984 | United Kingdom | 222/153.13 |

*Primary Examiner*—Philippe Derakshani
*Attorney, Agent, or Firm*—Watson, Cole Stevens Davis

[57] ABSTRACT

A pump dispenser has a plunger lock-up feature in which the plunger is positively retained against dislodgement by cradling projections on the piston stem against abutment shoulders of a locking sleeve which is fixed within the pump body of the dispenser. The pump body may be of an integral one-piece construction with the container closure, and the container vent opening is controlled by an upstanding sleeve on the piston cup for preserving the integrity of the piston seals.

6 Claims, 2 Drawing Sheets

PLUNGER LOCK-UP DISPENSER

BACKGROUND OF THE INVENTION

This invention relates generally to pump dispenser having a reduced number of parts, the dispenser having its plunger containing a discharge spout locked in a up position to avoid leakage during intervals of shipping and storage and to function as a childproof and safety feature.

Many pump dispensers are known as having lock-up and/or lock-down plunger features of various styles and structures. Many of such locking plunger dispensers provide for relative rotation between longitudinally extending ribs and grooves into misalignment and alignment of inoperative and operative positions of the plunger. However, many of such known dispensers require separate, rotatable lock collars to effect a match and mismatch between the ribs and grooves, thereby requiring at least one additional molded part which adds to the cost of the dispenser.

U.S. Pat. No. 4,162,746, commonly owned herewith, discloses a dispenser having a lock-up plunger requiring a rotatable lock ring in the form of an annular sleeve for matching and mismatching ribs on the piston stem with grooves at an inner wall of the lock ring.

U.S. Pat. No. 3,489,322 discloses another type plunger lock-up dispenser eliminating the need for a lock ring and instead providing for a match and mismatch between ribs and grooves upon relative rotation of the plunger head. However, the discharge spout is not made part of the head but is rather formed on a separate part which snap-fits together with the container closure, thereby significantly adding to the cost of the package.

Besides, these and other known plunger lock-up dispensers are not positively retained in the locked position such that the plunger head can be unintentionally rendered operative upon only a slight backoff from the misaligned position. Thus, if a dispensing package is dropped or nudged liquid product could easily leak from the spout even after the user has locked the plunger in place. Also, without a positive lock, a child of tender years can quickly figure out a way to unlock the plunger head thereby either creating a mess or an unsafe condition.

Many pump dispensers are of the type having a lost motion between the piston and piston stem, the latter being hollow and having lateral discharge ports which are uncovered upon a relative shifting movement of the stem upon plunger actuation. Typically, a container vent passage is closed in the at-rest condition of the plunger by an upper seal of the piston cup which operates within the pump cylinder. It is undesirable for the piston cup to be used in such manner for the opening and closing of the container vent passage as the seal could deteriorate thereby causing leakage.

SUMMARY OF THE INVENTION

It is therefore an object of the present invention to provide a pump dispenser having a plunger containing a spout which dispenser is economical to produce and assemble, requires a reduced number of parts compared to known dispensers of this type, is leak proof and has a plunger lock-up feature which includes a positive lock incapable of being inadvertently opened to an operative position of the plunger.

The pump dispenser according to the invention has a locking sleeve fixed within the pump body, a pump plunger having a discharge spout being rotatable in opposite directions about its central axis, extending through coaxial openings in the container closure and locking sleeve, and being disposed for reciprocation between lowered and spring biased raised positions. The locking sleeve has an upper edge wall with a upstanding limit stop at one end and a longitudinal groove at an opposite end of that wall. A detent on the wall adjacent the groove and spaced from the limit stop delimits an abutment shoulder with which a radially extending projection on the piston stem engages for locking the plunger in its raised position. Such projection is positively cradled between the detent and the limit stop.

The pump body and the container closure may be of a one-piece molded construction to minimize the number of parts required for the pump plunger.

A hollow piston stem is fixed to the plunger and extends through a piston cup for relative shifting movement upon plunger actuation to uncover lateral discharge ports to open the discharge. An inner upstanding sleeve on the piston cup seals against a lower edge of the locking sleeve for sealing a container vent passage closed in the at-rest position of the plunger.

Other objects, advantages and novel features of the present invention will become more apparent from the following detailed description of the invention when taken in conjunction with the accompanying drawings.

DETAILED DESCRIPTION OF THE INVENTION

Figures 1, 5:
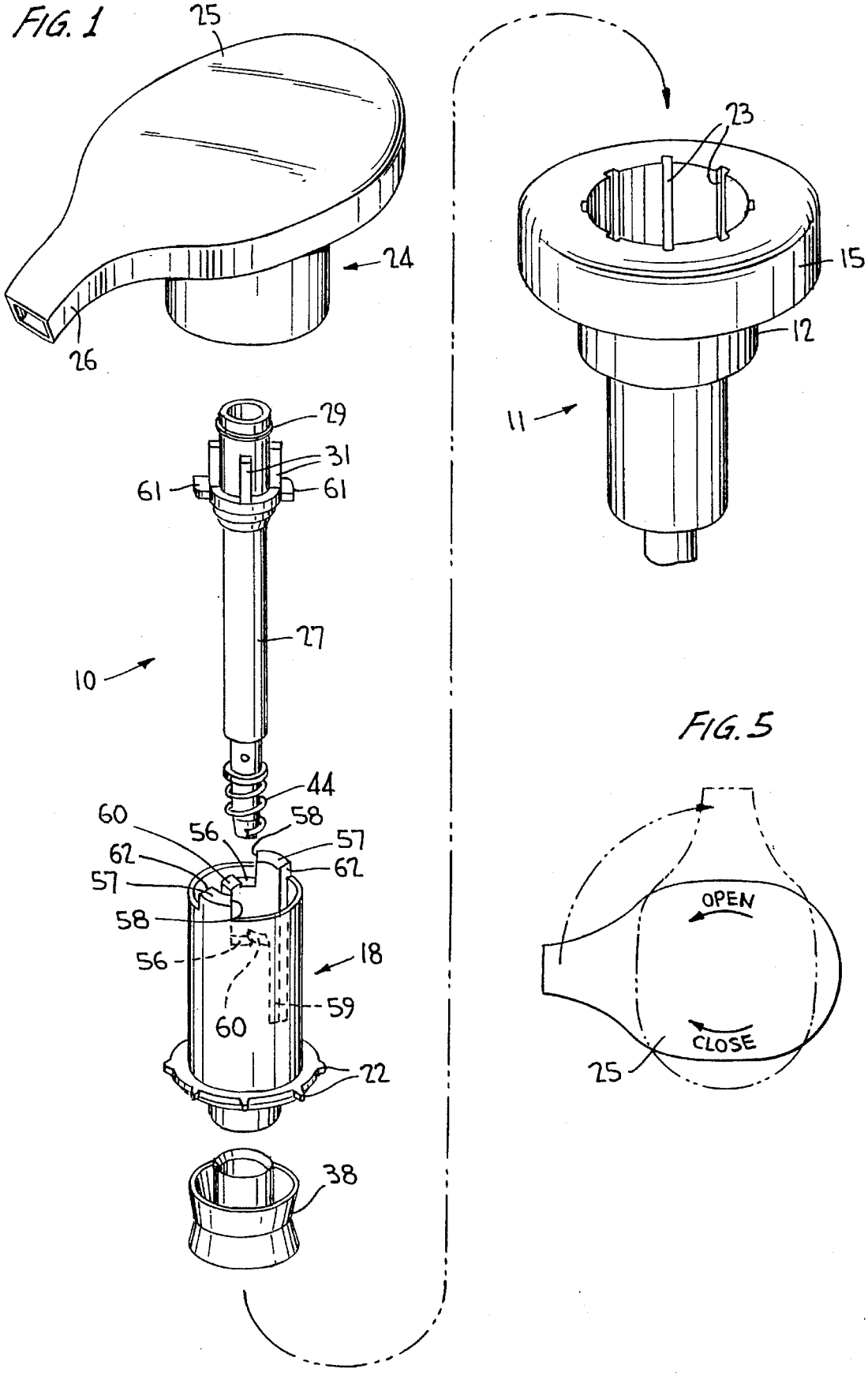
FIG. 1 is an expanded, perspective view of the pump dispenser according to the invention.
FIG. 5 is a top plan view of the plunger head showing the relative rotative movements thereof between open and closed positions.
Figure 2:
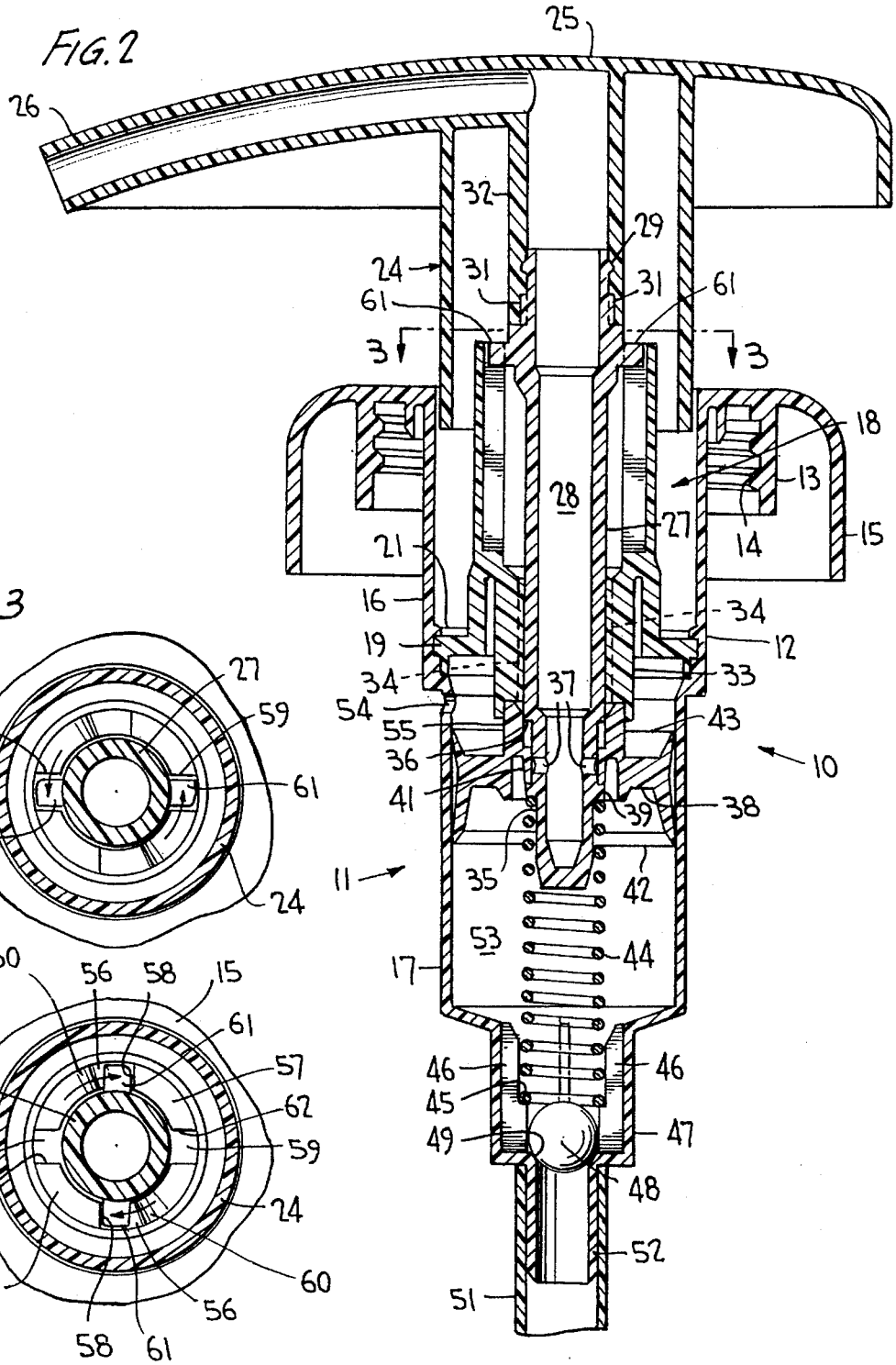
FIG. 2 is a vertical sectional view of the FIG. 1 pump with the parts assembled together.

Turning now to the drawings wherein like reference characters refer to like and corresponding parts throughout the several views, the pump dispenser according to the invention is generally designated 10 in FIGS. 1 and 2 as having a port 11 which may be of unitary molded construction forming a pump body 12 and a container closure 13. The closure has internal threads 14 for engagement with the external threads on the bottle neck of a container (not shown) for mounting the dispenser in place. An outer skirt 15 surrounding the closure may be provided for aesthetic purposes.

The pump body includes upper and lower cylindrical portions 16 and 17, the latter having a slightly smaller diameter and forming a pump cylinder.

A locking sleeve 18 is fixed within upper portion 16 of the pump body as by snap action between an annular flange 19 of the sleeve and an annular rib 21 integral with portion 16. Relative movement of the sleeve about its central axis is inhibited by the provision of tiny radial projections 22 (FIG. 1) engaging longitudinal grooves 23 extending along the inside of upper portion 16.

Plunger head 24 of the dispenser has a smooth contoured upper surface 25 which defines a smooth bearing surface for the fingers or palm of the hand of the operator. The plunger head has an integrally formed spout 26 in communication with a hollow piston stem 27 defining a discharge passage 28.

The piston stem is fixedly secured to the plunger head as by the provision of a snap bead 29, a plurality of longitudinally extending ribs 31 on the stem engaging mating grooves in sleeve 32 of the head to prevent relative rotation about the central axis of the parts.

A lower portion 33 of the locking sleeve has an inner diameter substantially equal to the outer major diameter of the piston stem, and has on its surface one or more longitudinal grooves 34 defining a vent path.

The lower end of the piston stem is constricted as at 35 so as to define an annular shoulder 36. One or more discharge ports 37 are provided in the wall of the constricted portion which extends through the central opening of a piston cup 38.

An annular bead 39 on constricted portion 35 engages an inner annular flange 41 on the piston cup which, in the at-rest position of the plunger shown in FIG. 2, covers ports 37 for closing the discharge.

The piston cup has a lower chevron seal 42 in sealing engagement with the wall of the pump cylinder, and has an upper chevron seal 43 likewise in sealing engagement with the wall of the pump cylinder.

A piston return spring 44 extends between bead 39 and shoulders 45 of spring centering ribs 46 located within throat portion 47 of the pump body which houses an inlet ball check valve 48 shown in engagement with its valve seat 49. A dip tube 51 connected to a nipple 52 extending from throat section 47 extends into the container (not shown). Ribs 46 and the lowermost most turn of the return spring form a ball cage for the inlet ball check valve.

In the at-rest position of the plunger of FIG. 2, shoulder 36 is spaced a predetermined axial distance from flange 41 such that, upon depression of the plunger head, the piston stem shifts relative to the piston cup exposing discharge ports 37 to the product in pump chamber 53 such that continued depression of the head reciprocates the piston within its cylinder pressurizing the liquid product in the pump chamber forcing it through the discharge ports, discharge passage 28 and outwardly through the spout, as in a known manner. Upon removal of the downwardly applied manual force to the head, the return spring shifts the piston stem relative to the piston back to its FIG. 2 position closing the discharge ports and returning the piston to its FIG. 2 position whereupon the pump chamber volume expands such that a corresponding drop in pressure therein suctions product from the container up through the dip tube and the unseated inlet ball check valve and into the pump chamber.

The product evacuated from the container must be replenished by air to prevent hydraulic lock and container collapse. For this purpose a container vent port 54 is provided in the wall of pump cylinder 17 above chevron seal 43 in the at-rest position of the plunger. An internal, upstanding sleeve 55 on the piston engages the underside of lower portion 33 of the locking sleeve and has an inner diameter substantially equal to the outer diameter of piston stem so as to seal the vent grooves 34 closed in the FIG. 2 position. Also, sleeve 55 maintains the axial spacing between shoulder 36 and flange 41 in the at-rest position of the plunger.

Therefore, upon plunger depression at sufficient distance to shift the piston inwardly of its cylinder, vent grooves 34 are opened establishing a vent passage to the atmosphere from inside the container via vent port 54. And, by spacing the chevron seals of the piston cup away from vent port 54 so as to avoid sliding contact, any scoring of the piston seals is avoided. Also, no portion of the piston seals engages the locking sleeve or any other element for maintaining the vent grooves closed in the at-rest position of the plunger, as in prior art constructions. Thus, the somewhat delicate piston seal is thereby preserved from damage and scoring which could otherwise cause leakage.

The plunger lock-up feature according to the invention is facilitated by the provision of a pair of opposing edge walls 56 lying in a plane perpendicular to the central axis of sleeve 18. An upstanding limit stop 57 having a longitudinally extending edge 58 is located at one end of each edge wall 56. At the other end of each edge wall is a longitudinal extending groove 57, and a detent 60 is provided on each edge wall 56 adjacent each groove 59 and spaced from edge 58 to thereby define edge wall 56 as an abutment shoulder.

The piston stem has a pair of opposing projections 61 for matching and mismatching with grooves 59 upon a relative rotation of the plunger head to that of the locking sleeve.

Figure 3:
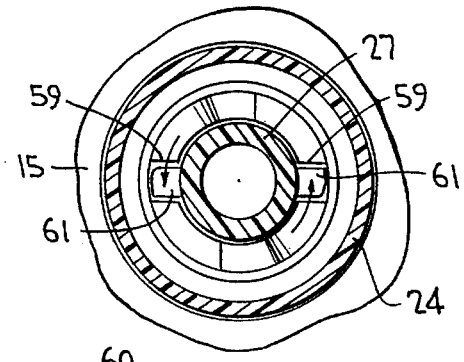
FIG. 3 is a sectional view taken substantially along the line 3—3 of FIG. 2 with the plunger in its operative position.

Thus, in operation, upon rotation of the plunger head in the direction of the "OPEN"arrow shown in FIG. 5, projections 61 are aligned with grooves 59 (shown in FIG. 3) to thereby permit unimpeded reciprocation of the plunger head in an operative position for dispensing product from the primed pump chamber in a manner known in the art.

Figure 4:
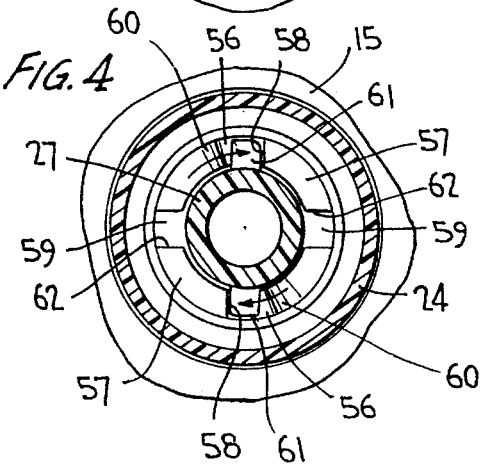
FIG. 4 is a view similar to FIG. 3 of the plunger in its locked up, inoperative position.

At the end of the plunger upstroke, such as that shown in FIG. 2, when it is desired to lock the plunger against reciprocation in its up and inoperative position, the plunger head is simply rotated about its central axis through about 90° in the direction of "CLOSE" arrow of FIG. 5, opposite that of the "OPEN" arrow, such that projections 61 override detent 60 and engage shoulders 56 (see FIG. 4) as limited in the circumferential travel of the projections by longitudinal edges 58 of the limit stops. Thus, edges 58 and detents 60 present a cradling action for projections 51, the detent positively retaining the projections in place under the bias of the return spring. Thus, any slight nudge of the plunger head in the OPEN direction will not overcome the positive retention presented by the detents. Even if the dispensing package is dropped, it is unlikely that the plunger head will be forced to rotate into its OPEN position due to the positive retention feature of the invention.

Moreover, in the process of the circumferential travel of projections 61 from a position in alignment with grooves 59 to a cradled position against abutment shoulders 56, the operator is able to sense the tracking movement of the projections 61 about the detents, such that the detents likewise provide an indexing function for the operator.

When the plunger head is rotated about its axis in the direction of its "CLOSE" arrow, the resistance offered by the detents is easily overcome by the operator until the projections realign with grooves 59. In such realigned position, projections 61 abut against longitudinal edges 62 of the limit stops, opposite edges 58, thereby preventing projections 61 from overriding grooves 59.

From the foregoing it can be seen that a simple and economical yet highly effective pump dispenser has been provided according to the invention permitting a positive plunger lock-up, limiting the number of parts required for the dispenser, and preserving the integrity of the piston cup.

Obviously, many other modifications and variations of the present invention are made possible in the light of the above teachings. For example, the locking sleeve could include a single abutment shoulder, detent and limit stop and groove for a single projection 61, without departing from the invention. It is therefore to be understood that within the scope of the appended claims the invention may be practiced otherwise than as specifically described.

What is claimed is:

1. A liquid pump dispenser comprising, a pump body including a container closure, a locking sleeve fixedly mounted in said pump body, a manually actuated pump plunger having a discharge spout rotatable in opposite directions about a central axis thereof and extending through coaxial openings in said closure and sleeve and being disposed for reciprocation between lowered and spring biased raised positions, said locking sleeve having at least one edge wall lying in a plane perpendicular to said axis, at least one upstanding limit stop at one end of said wall, and at least one longitudinal groove at an opposite end of said wall, a detent on said wall adjacent said groove, said wall between said detent and said stop defining an abutment shoulder, said plunger having at least one radially extending projection in engagement with said shoulder in one rotative position of said plunger about said axis to lock said plunger in said raised position, as said projection is in a cradled position between said detent and said limit stop for positively retaining said plunger in said one rotative position, said projection sliding along said detent and being placed into alignment with said groove upon rotation of said plunger about said axis to another rotative position opposite said one position to unlock said plunger for reciprocation.

2. The dispenser according to claim 1, wherein said closure and said pump body are of one-piece molded construction, said pump body defining a pump cylinder.

3. The dispenser according to claim 2, wherein said plunger includes a hollow piston stem, a piston mounted on said stem and being in sliding sealing engagement with said cylinder to therewith define a variable volume pump chamber, said stern extending through coaxial opening in said piston and sleeve.

4. The dispenser according to claim 3, wherein said cylinder has a container vent opening located outside said pump chamber, said sleeve opening being oversized relative to said stem to define a container vent passage in communication with said vent opening to establish a vent path in said lowered position, said piston in said raised position sealingly engaging said locking sleeve for closing said vent path.

5. The dispenser according to claim 3, wherein said piston stem defines a liquid discharge passage communicating with the discharge spout on said plunger, said stem having a discharge port establishing communication with said pump chamber and said spout in a discharge open position, said piston covering said port in a discharge closed position, and said piston being mounted on said stem for relative shifting movement into said discharge open position.

6. The dispenser according to claim 1, wherein said locking sleeve has a pair of circumferentially spaced apart edge walls in said plane, upstanding limit stops respectively at one end of each said wall, and longitudinal grooves respectively at an opposite end of each said wall, detents on said wall respectively adjacent said grooves, said walls between said detents and said stops defining abutment shoulders, said plunger having a pair of circumferentially spaced, radially extending projections in engagement with said shoulders in said one rotative position.

* * * * *